United States Patent [19]

Williams

[11] Patent Number: 4,530,536

[45] Date of Patent: Jul. 23, 1985

[54] LIFTING TONGS

[76] Inventor: James N. Williams, 1643 Market St., Mount Ephraim, N.J. 08059

[21] Appl. No.: 571,950

[22] Filed: Jan. 19, 1984

Related U.S. Application Data

[63] Continuation-in-part of Ser. No. 339,108, Jan. 13, 1982, Pat. No. 4,452,481.

[51] Int. Cl.[3] ..... B66C 1/42

[52] U.S. Cl. ..... 294/118; 294/86.4

[58] Field of Search ..... 294/118, 88 R, 106, 294/119, 90, 86 R, 101, 114, DIG. 1, DIG. 2, 115

[56] References Cited

U.S. PATENT DOCUMENTS 3,948,552 4/1976 Hamrick ..... 294/118

FOREIGN PATENT DOCUMENTS 2260720 12/1972 Fed. Rep. of Germany ..... 294/118

1427213 12/1965 France ..... 294/118

*Primary Examiner*—James B. Marbert

*Attorney, Agent, or Firm*—Duffield & Lehrer

[57] ABSTRACT

Lifting tongs for a crane include a pair of tong arms pivoted together adjacent their centers. A tension spring biases the tongs into a closed position and a pneumatic cylinder moves the tongs opened and closed. A pair of jaws are mounted to the lower ends of the tong arms. Each jaw includes a substantially horizontal slot and a vertical wall extends upwardly from the opening at the mouth of the slot. As the jaws are closing, the vertical walls guide the edges of the article to be lifted into the slots. Movable shims within the slots adjust the height of the slots so that the tongs can be used to lift articles of different sizes.

6 Claims, 6 Drawing Figures

LIFTING TONGS

CROSS REFERENCE TO RELATED APPLICATIONS

This application is a continuation in part of prior application Ser. No. 339,108, filed Jan. 13, 1982 for Lifting Tongs now U.S. Pat. No. 4,452,481.

BACKGROUND OF THE INVENTION

The present invention is directed toward lifting tongs for use with a crane and more particularly toward such lifting tongs which are specifically adapted to lift I-beams and similar materials of different sizes.

Various lifting tongs for lifting I-beams and the like have been proposed in the past. These are shown, for example, in U.S. Pat. Nos. 3,201,167 and 3,572,808. In each of these patents, the tongs include jaws which fit around the edges of the top flange of the I-beam. While these devices would appear to have some value for a particular size I-beam, they cannot safely be used with different size I-beams having different widths or thicknesses.

In co-pending application Ser. No. 339,108, filed Jan. 13, 1982, Applicant describes lifting tongs which have adjustable and interchangeable jaws so that the same can be used to lift I-beams of various different sizes. While the device shown in this prior application has many advantages over the prior art as described in said application, it does have certain limitations. The most significant of these is the fact that two people are required to operate the device. That is, a worker is needed to align the jaws with the flange on the I-beam as the jaws are being closed therearound. This not only results in a potentially dangerous situation for the worker but also adds considerable expense to the cost of operating the equipment.

SUMMARY OF THE INVENTION

The present invention is designed to overcome the deficiencies of the prior art and of the prior application described above and provides lifting tongs which are capable of properly and safely gripping I-beams of various different sizes and which can be operated by one person. In accordance with the invention, lifting tongs for a crane include a pair of tong arms pivoted together adjacent their centers. A tension spring biases the tongs into a closed position and a pneumatic cylinder moves the tongs opened and closed. A pair of jaws are mounted to the lower ends of the tong arms. Each jaw includes a substantially horizontal slot and a vertical wall extends upwardly from the opening at the mouth of the slot. As the jaws are closing, the vertical walls guide the edges of the article to be lifted into the slots. Movable shims within the slots adjust the height of the slots so that the tongs can be used to lift articles of different sizes.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
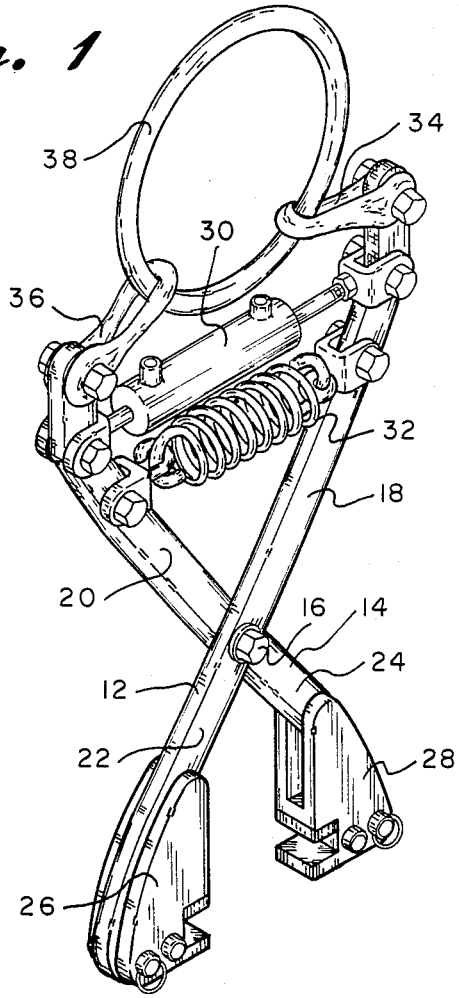
FIG. 1 is a perspective view of lifting tongs constructed in accordance with the principles of the present invention.

Referring now to the drawings in detail wherein like reference numerals have been used throughout the various figures to designate like elements, there is shown in FIG. 1 a perspective view of lifting tongs constructed in accordance with the principles of the present invention and designated generally as 10. The tongs 10 are comprised essentially of a pair of tong arms 12 and 14 which are pivoted together at approximately their midpoints by a pivot pin 16 thereby forming upper tong arm portions 18 and 20 and lower tong arm portions 22 and 24.

As will be explained in more detail hereinafter, jaws 26 and 28 are mounted on the ends of the lower tong arm portions 22 and 24, respectively. The lower tong arm portions and the jaws can be moved toward and away from each other by the use of a pneumatic or hydraulic cylinder 30 connected between the upper tong arm portions 18 and 20. This is, of course, by way of example only as other types of motive means such as an electric solenoid or the like could also be used. A tension spring 32 also connected between the upper tong arm portions 18 and 20 biases the lower tong arm portions 22 and 24 and the jaws 26 and 28 into a closed position, i.e. toward each other.

Pivotally connected to the extreme upper ends of the upper tong arm portions 18 and 20 are guide loops 34 and 36, respectively. Passing through the guide loops 34 and 36 is a ring 38. A hook or similar device from a lifting crane is adapted to be connected to the ring 38 for the purpose of moving the tongs 10 near the material being carried thereby. It should be readily apparent that the ring 38 and the guide loops 34 and 36 cooperate to provide an inward force on the upper tong portions 18 and 20 and thus the lower tong portions 22 and 24 whenever a vertical force such as from a crane is applied to the ring 38.

Figure 2:
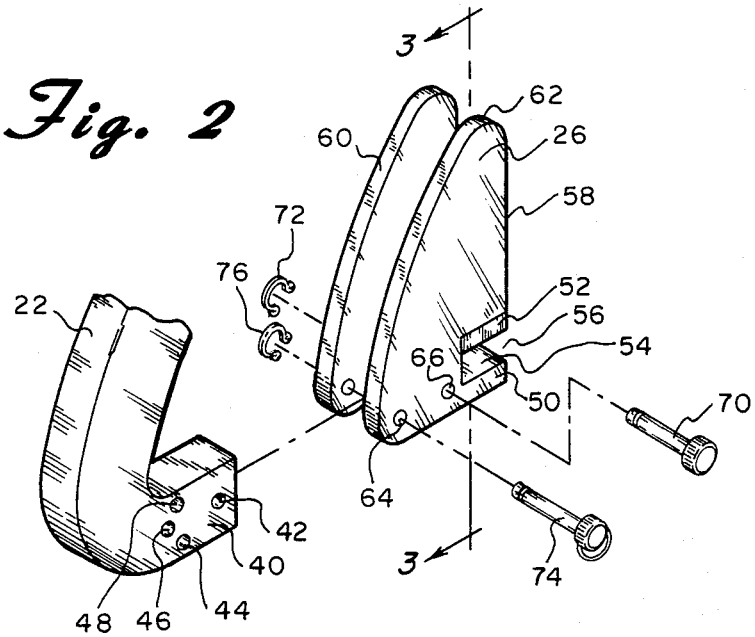
FIG. 2 is a detailed view showing the manner in which the jaws are attached to the tong arms.

The details of the jaws 26 and 28 and the manner in which they connect to the lower tong arm portions are shown most clearly in FIG. 2. Only jaw 26 and lower tong arm portion 22 are illustrated in detail in this figure. It should be understood, however, that the following explanation applies equally to the other jaw 28 and lower tong arm portion 24.

Referring now to FIG. 2, it can be seen that the extreme lower end 40 of the tong arm portion 22 is bent inwardly to a substantially horizontal position. A first hole 42 adjacent the end passes through the horizontal portion 40 substantially centrally thereof. Located slightly inwardly from the hole 42 are a series of substantially vertically aligned holes 44, 46 and 48.

The jaw 26 includes a lower jaw member 50 which lies in a substantially horizontal plane. Also lying in a substantially horizontal plane but spaced from the lower jaw member 50 is an upper jaw member 52. Lying between the faces of the upper and lower jaw members 50 and 52 is a substantially horizontally extending slot 54. The slot 54 has an opening 56 at the forward end thereof which is toward the interior of the tongs. A substantially flat vertical wall 58 extends upwardly from the top of the opening 56 of the slot 54 and functions as a cam or guide member in a manner which will become more apparent hereinafter.

The rear and top portions of the jaw 26 are bifurcated such as shown at 60 and 62 so that the same can be fit over the lower tong arm portion 22 and end portion 40. Formed in the bifurcated walls 60 and 62 are holes 64 and 66 which are adapted to cooperate with the various holes in the end 40 of the lower tong arm portion 22. More particularly, the jaw 26 fits over the end portion 40 with hole 66 in alignment with hole 42 and hole 64 in alignment with either one of holes 44, 46 or 48. With the jaw 26 in place, pivot pin 70 is inserted through holes 66 and 42 and is retained therein by way of a spring clip 72 or a similar device. Hole 64 is aligned with either of the holes 44, 46 or 48 and is retained in the desired position by pin 74 and spring clip 76.

Figure 3:
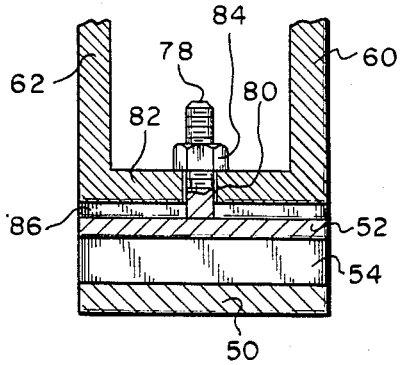
FIG. 3 is a cross-sectional view taken through the line 3—3 of FIG. 2.

As shown most clearly in FIG. 3, the upper jaw member 52 is selectively movable so that the height of the slot 54 can be adjusted. This is necessary to prevent an I-beam or similar object from slipping. The adjustment feature is provided by way of bolt 78 which is securely fastened to the back of the upper jaw member 52 and which passes through hole 80 in the wall 82 joining the bifurcated portions 60 and 62. By turning nut 84, upper jaw member 52 can be moved upwardly or downwardly. When it is in its approximate desired position, a shim or similar device can be inserted into the gap 86 between the jaw member 52 and the wall 82 and the nut 84 can then be securely tightened. The shim not only provides structural rigidity to the upper jaw member 52 but also acts as a continuation of the smooth front wall 58.

Figure 4:
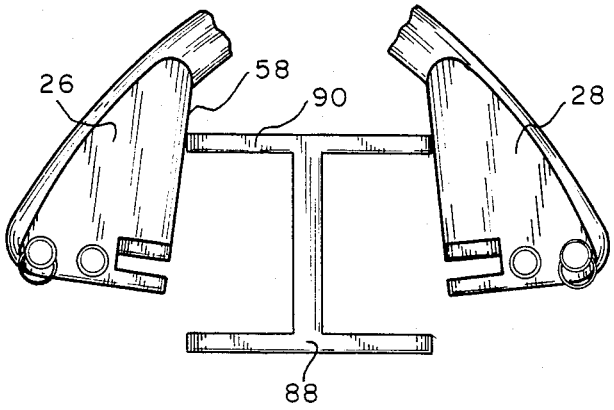
FIG. 4 illustrates the jaws as they are closed onto an I-beam but out of alignment with respect to the flange thereof.
Figure 5:
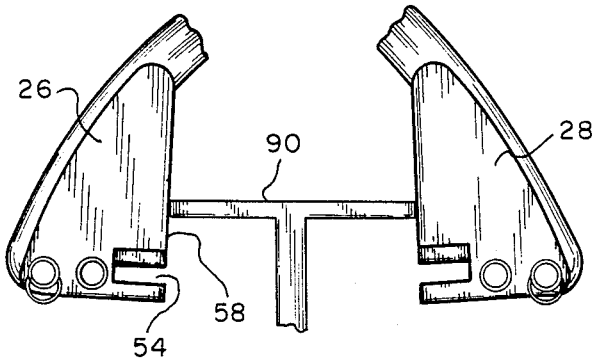
FIG. 5 is a view similar to FIG. 4 but showing the jaws being moved into proper alignment.
Figure 6:
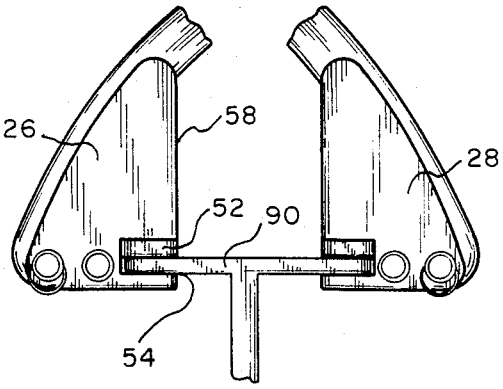
FIG. 6 is a view similar to FIGS. 4 and 5 showing the jaws in proper alignment with the flange of an I-beam.

FIGS. 4, 5 and 6 illustrate the manner in which the lifting tongs of the present invention are utilized for lifting an I-beam 88 which has an upper flange 90. The cylinder 30 is first energized so that the jaws 26 and 28 are spread apart. Thereafter, the jaws are lowered into position on either side of the flange 90 and the tongs are closed so that the side edges of the flange 90 are engaged by the vertical walls 58 of the jaws 26 and 28. It should be readily apparent that the flange may be engaged at substantially any point along the vertical walls 58 and accordingly an additional worker is not needed to guide the tongs into place. The tongs are then lifted so that the vertical walls 58 are moved upwardly and the flange 90 slides down as shown in FIG. 5. Further movement of the tongs brings the flange into alignment with the opposed slots 54. At this point, the outer edges of the flange 90 fit into the slots as shown in FIG. 6 and the I-beam can be lifted by the lifting tongs.

The present invention may be embodied in other specific forms without departing from the spirit or essential attributes thereof and accordingly reference should be made to the appended claims rather than to the foregoing specification as indicating the scope of the invention.

I claim:

1. Lifting tongs for a crane comprising:

a pair of tong arms, said tong arms being pivoted together intermediate the ends thereof forming an upper tong arm portion and a lower tong arm portion on each tong arm;

means for moving said lower tong arm portions toward and away from each other;

a jaw adapted to be mounted to the end of each of said lower tong arm portions;

each of said jaws including a substantially horizontally extending slot having an opening toward the interior of said tongs so that the openings in said jaws face each other and a substantially flat vertical wall extending upwardly from the top of the opening of said slot whereby, when said jaws are closing, said vertical walls guide the edges of the article to be lifted into said slots.

2. Lifting tongs as claimed in claim 1 including means for securely mounting each of said jaws to its respective lower tong arm portion in one of a plurality of different positions.

3. Lifting tongs as claimed in claim 1 including means for adjusting the height of each of said slots.

4. Lifting tongs as claimed in claim 1 wherein said means for moving said lower tong arm portions toward and away from each other includes a pneumatic cylinder means.

5. Lifting tongs as claimed in claim 4 further including a tension spring biasing said lower tong arm portions into a closed position.

6. Lifting tongs as claimed in claim 1 wherein said jaws are pivotally movable into each of said different positions and including a pin for locking each jaw in its desired position.

* * * * *